United States Patent [19]

Kulesza et al.

[11] 3,985,075

[45] Oct. 12, 1976

[54] MULTI-DIRECTIONAL FIRING DEVICE

[75] Inventors: Stanley Kulesza, Brooklyn, N.Y.; William D. Robison, Cedar Grove, N.J.

[73] Assignee: The United States of America as represented by the Secretary of the Army, Washington, D.C.

[22] Filed: Mar. 19, 1975

(Under Rule 47)

[21] Appl. No.: 559,951

[52] U.S. Cl. ..... 102/8; 102/70 S

[51] Int. Cl.[2] ..... F42B 23/26

[58] Field of Search ..... 102/8, 16, 70 S, 70 R

[56] References Cited

UNITED STATES PATENTS

| | | | |
|---|---|---|---|
| 2,935,949 | 5/1960 | Holford | 102/8 X |
| 3,034,435 | 5/1962 | Schermuly | 102/70 R |
| 3,272,125 | 9/1966 | Adams | 102/70 R |
| 3,679,487 | 7/1972 | Coyle | 102/70 R X |
| 3,730,100 | 5/1973 | Hadfield | 102/70 S |

*Primary Examiner*—David H. Brown

*Attorney, Agent, or Firm*—Nathan Edelberg; A. Victor Erkkila; Ronald M. Spann

[57] ABSTRACT

A multi-directional initiating device for firing a detonator is triggered by an inward or outward displacement of one or both slider means, which operatively engage a pivoting double sear mounted on a biased shaft carrying a firing pin when the device is armed or cocked.

5 Claims, 2 Drawing Figures

MULTI-DIRECTIONAL FIRING DEVICE

GOVERNMENTAL INTEREST

The invention described herein was made under a contract with the Government.

BACKGROUND OF THE INVENTION

Various means have been used in the past to initiate a detonator. One of the problems with prior art initiating devices has been their inability to be triggered from different directions. As a result, it was necessary to provide separate devices of different design to achieve different modes of function, which is costly and presents logistics and inventory problems.

SUMMARY OF THE INVENTION

One of the objects of this invention is to provide a uni- and multi-directional detonator initiating means in one device.

Another object of this invention is to provide a multi-directional capability in a detonator initiating means for a booby trap.

A further object of this invention is to provide a detonator initiating means capable of being selectively set for one or more modes of operation.

The foregoing and other objects are achieved in accordance with the present invention by the provision of a multi-directional detonator initiating or firing device, wherein both ends of a pivoting lever, which is mounted on a biased shaft carrying a firing pin, are releasably engaged by two slider means protruding through the housing of the device. In the preferred embodiment, the axes of travel of the two slider means are perpendicular to each other. The detonator initiating means will become operational when at least one of said slider means of the device has been sufficiently displaced inwardly or outwardly to disengage at least one end of the pivoting lever, thereby releasing the biased shaft to impinge the firing pin on the detonator.

For a better understanding of the present invention, reference is made to the following description taken in connection with the accompanying drawings.

BRIEF DESCRIPTION OF THE DRAWINGS

Throughout the following description like reference numerals are used to denote like parts of the drawings.

DESCRIPTION OF THE PREFERRED EMBODIMENTS

Figure 1:
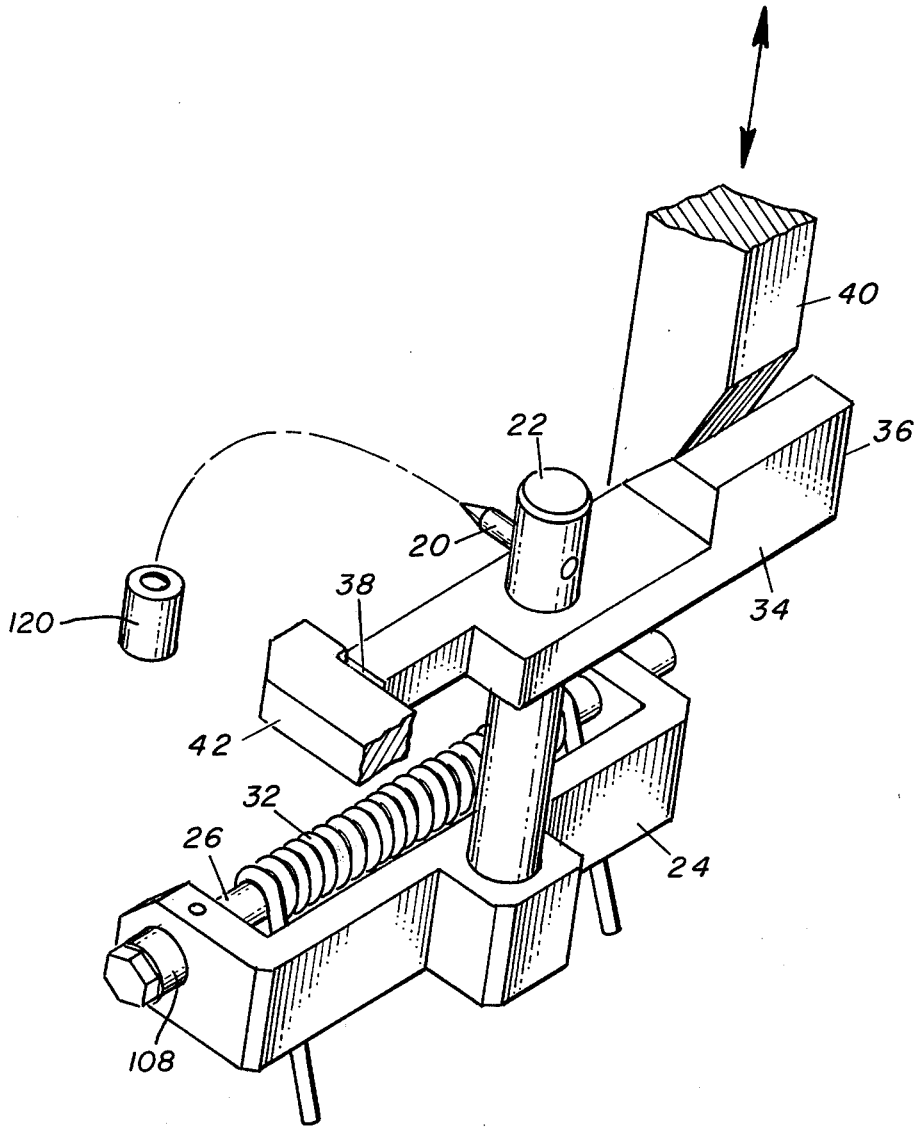
FIG. 1 is a partial cut-away diagrammatic view of the multi-directional firing device in the cocked position for initiating a detonator.
Figure 2:
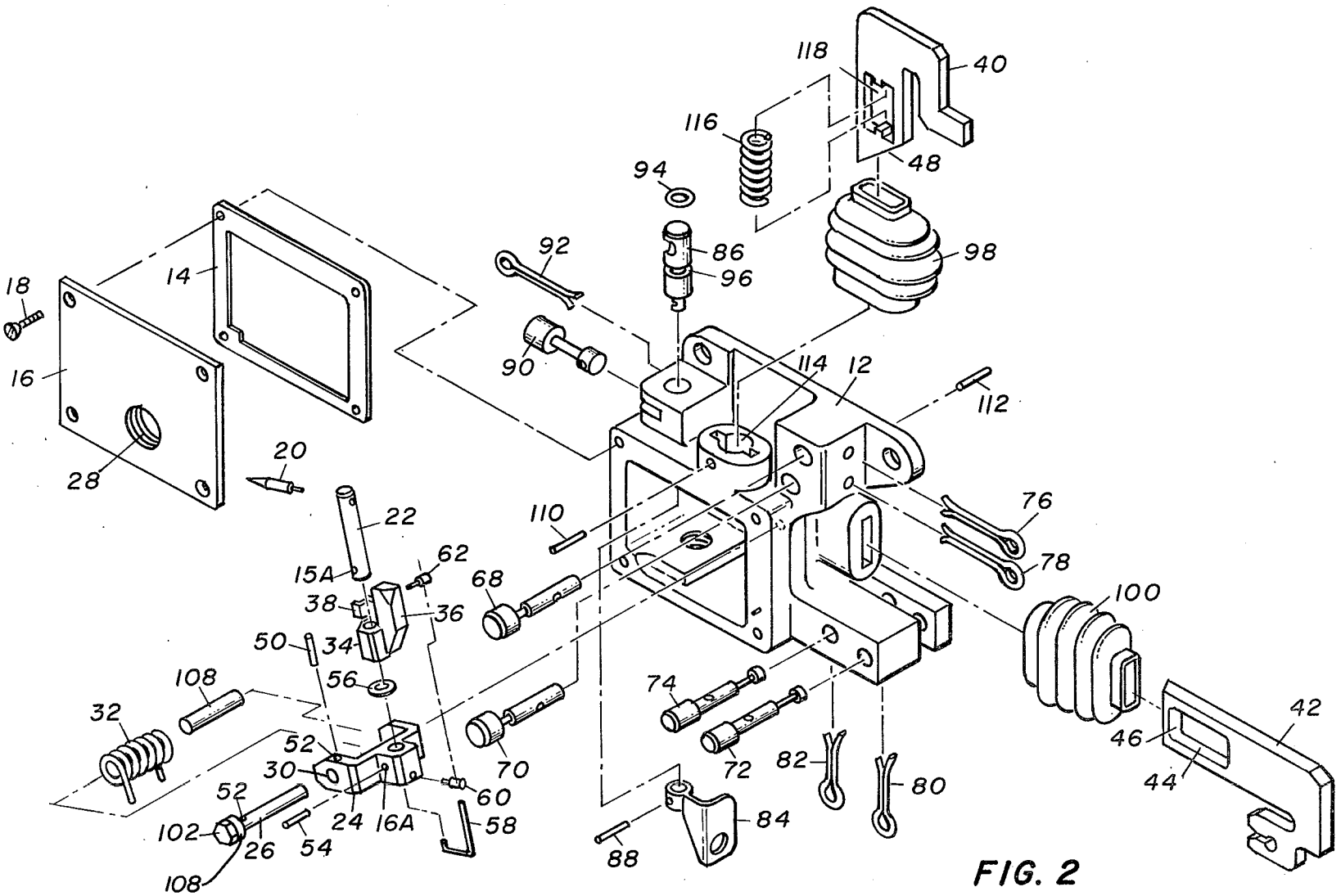
FIG. 2 is an exploded assembly drawing of the multi-directional firing device for initiating a detonator.

Referring now to FIGS. 1 – 2 the device 10 has an approximately rectangular box housing 12, a matching gasket 14 and cover 16, held thereon by four screws 18. A firing pin 20 is carried by a shaft 22, which is affixed to a yoke support 24 rotatably mounted on a stud 26. The stud 26 is rotatably held in hole 28 in cover 16 and passes through holes 30 in yoke support 24. The support 24 is urged by a torsion spring biasing means 32 to rotate the firing pin shaft toward the detonator (not shown in FIG. 2). A lever means 34 having two ends 36 and 38 is pivotably positioned on the biased firing pin shaft 22. Protruding through and mounted in the housing 12 are a second slider means 40 operatively engaging one end 36 of said lever 34 and a first slider means 42 operatively engaging the other end 38 of said lever means 34 and having an axis of travel perpendicular to that of the second slider means 40. When the firing pin 20 is in the armed or cocked position, as shown in FIG. 1, the lever end 38 is held in slot 44 of slider 42 against the front end 46 of said slot 44, while the lever end 36 is restrained by engagement with the slanted end 48 or slider 40.

Pin 50, inserted in holes 52 common to support 24 and stud 26, locks the stud 26 to the support 24, while the firing pin shaft 22 is locked to support 24 by pin 54 inserted in holes 16A and 15A. Washer 56 mounted on shaft 22 facilitates the ability of lever 34 to pivot. A reset mode is given lever 34 by reset spring 58 secured to support 24 by spring guide 60 and to lever 34 by spring guide 62. The torque on lever 34 by spring 58 is less than the bias or torque exerted by torsion spring 32 on lever 34 when one or both ends of lever 34 are operatively disengaged from sliders 40 and 42. Removable setting pins 68, 70, 72, 74 lock slider means 40, 42 for safing the device 10. Cotter pins 76, 78, 80, 82 respectively positively detent setting pins 68, 70, 72, 74.

Safety barrier 84 is secured to the safety barrier shaft 86 by spring pin 88. Safety barrier pin 90 serves as a locking means on the safety barrier shaft 86. Safety barrier 86 is locked and prevented from rotating in the housing 12 by cotter pin 92. By selective insertion and removal of the cotter pin 92 and the safety barrier pin 90, the safety barrier shaft 86 may be rotated and/or removed provided that in the latter case the spring pin 88 has also been removed. By this selection it is possible to positively "safe" or "unsafe" an armed or cocked device 10. O-ring 94, in annular groove 96 of safety barrier shaft 86, in combination with cover 16, gasket 14, and boots 98 and 100 provide means of preventing or lessening entry of foreign matter into the device 10. Cover 16 with gasket 14 is affixed to the housing 12 by four screws 18.

The spacer 108 mounted on stud 26 prevents binding and/or disorienting of the support 24. Slider stop pins 110 and 112 prevent overtravel or over displacement of the second and first slider means 40, 42 respectively. Slider 40 is positioned in guide channel 114 in housing 12 and contains a compression spring 116, which is mounted in slot 118.

Slider spring 116 provides the bias required by the second slider means 40 to counteract that imparted to the second slider means 40 by lever end 36 due to the combined net effect created by the above described mechanical linkage impelled by torsion spring 32 and guide spring 58.

The device 10 is cocked or armed by rotating the yoke support 24 clockwise about the stud 26 against the torsion spring biasing means 32 until the lever means ends, 36, 38 operatively engage the second 40 and first 42 slider means.

Cover 16 may be either transparent or opaque depending on whether the device is intended for exhibition, testing or actual use. If device 10 is intended for exhibition or test purposes, stud 26 is provided with a head 102 projecting outside the cover 16 whereby the stud 26 can be rotated to position lever 34 for engagement with slider ends 46 and 48 to facilitate cocking, and recocking, and testing. For actual field use, stud 26 can also terminate in a round recess in the cover 16.

In operation the multi-directonal initiating device 10 for firing a detonator is triggered by an inward or outward displacement of one or both slider means 40, 42, which operatively engage a pivoting lever or double sear 34 mounted on a biased shaft 22 carrying a firing pin 20 when the device 10 is armed or cocked. Upon being triggered, the following events must occur for the device to function:

a. The lever means 34 is caused to pivot about the shaft 22 by the biasing force of the torsion spring 32 on stud 26 until one or both ends 36, 38 of lever means 34 operatively disengage the slider means 40, 42.

b. Torsion spring biasing means 32 rotates yoke support 24 about stud 26 in a counter clockwise rotation to impinge the firing pin 20 on the detonator.

It should be noted that if the second slider 40 is pushed inwardly simultaneously as the first slider 42 is pulled outwardly such that the net torque exerted by sliders 40 and 42 on the lever means 34 is less than the righting torque imparted by the reset spring 58, the lever means 34 will not rotate and the device 10 will not be triggered. Other than the fact situation just described, the device 10 may be triggered by an inward or outward displacement of one or both sliders 40, 42 due to the pivoting double sear 34. For example, if the second slider 40 is locked in a stationary position by removable setting pins 68 and 70, the first slider 42 may be moved inwardly or outwardly a distance sufficient to permit the lever means 34 to pivot on shaft 22 until end 38 of lever means 34 clears slider end 46, whereby the firing pin shaft 22 is freed to swing an arc and impinge the firing pin 20 on the detonator; alternatively, if the first slider 42 is locked in a stationary position by removable setting pins 72, 74 and the second slider 40 is moved inwardly or outwardly a distance sufficient to cam the lever means 34 through an angle large enough that end 38 of lever means 34 no longer operatively engages the slider end 46, the firing pin shaft 22 is freed to swing an arc and impinge the firing pin 20 on the detonator. Finally, if the second slider 40 is prevented from inward movement by insertion of setting pin 70, the device 10 may be triggered by an outward movement of second slider 40, inward movement of first slider 42, outward movement of first slider 42, and an outward movement of second slider 40 coupled with an inward or outward movement of the first slider 42. This is so because the outward movement of the second slider 40 operatively disengages the lever end 36, permitting the lever means 34 to pivot and operatively disengage its remaining end 38 from the first slider 42 such that shaft 22 is no longer restrained from swinging an arc and impinging the firing pin 20 on a detonator.

Having thus fully described the invention, what is claimed as new and desired to be secured by Letters Patent of the United States is:

1. A multi-directional firing device comprising in combination:

a housing;

a firing pin carried on a shaft positined on a pivotal mounting in said housing;

biasing means for rotating said shaft through an angular stroke to impinge the firing pin on a detonator;

a lever having two ends and pivotally positioned on said shaft;

a first slider means protruding through and movable within said housing and operatively engaging one end of said lever means;

a second slider means protruding through and movable within said housing operatively engaging the other end of said lever means and adapted to travel along a different axis than said first slider means, whereby the firing pin is retained in the armed position when both ends of said lever means are engaged by said slider means and released to strike the detonator when at least one of said slider means, by a force applied to its protruding part, is caused to travel a sufficient distance in either forward or rearward directon to cam said lever means through a sufficient angle to disengage an end of said lever means and thereby release said biased shaft to rotate and impinge said firing pin on the detonator.

2. The device of claim 1, wherein the second slider means travels along an axis substantially perpendicular to the axis of travel of the first slider means.

3. The device of claim 1, wherein the biasing means comprises a torsion spring which rotates a support means on which said shaft is mounted.

4. The device of claim 3, wherein the first slider means has a catch for releasably holding one end of said lever means and the second slider means has a slanted end for releasably engaging the other lever means end, and biasing means to maintain said second slider means slanted end in engagement with said other lever means end.

5. The device of claim 3, wherein said lever means and a shaft support means are connected by a reset spring for returning said lever means ends in engageable alignment with said first and second slider means, and said firing pin shaft support means is pivotally mounted in said housing by means of a shaft protruding through said housing for returning said firing pin to the armed position.

* * * * *